US010330450B1

(12) United States Patent
Kokodis et al.

(10) Patent No.: US 10,330,450 B1
(45) Date of Patent: Jun. 25, 2019

(54) SCALABLE MINE DEPLOYMENT SYSTEM

(71) Applicant: The United States of America as Represented by the Secretary of the Army, Washington, DC (US)

(72) Inventors: Victor Kokodis, Wharton, NJ (US); Joseph Turci, Long Valley, NJ (US); George Sudol, Kenvil, NJ (US); Edward Cole, Easton, PA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/925,880

(22) Filed: Mar. 20, 2018

Related U.S. Application Data

(60) Provisional application No. 62/481,341, filed on Apr. 4, 2017.

(51) Int. Cl.
*F41F 5/00* (2006.01)
*F42B 23/24* (2006.01)
*F42B 23/04* (2006.01)

(52) U.S. Cl.
CPC ..... *F42B 23/24* (2013.01); *F42B 23/04* (2013.01)

(58) Field of Classification Search
CPC ..... F41F 1/00; F41F 1/08; F41F 7/00
USPC ..... 89/1.11
See application file for complete search history.

(56) References Cited

U.S. PATENT DOCUMENTS

| | | | | |
|---|---|---|---|---|
| 4,296,669 | A | 10/1981 | Debona | |
| 4,466,332 | A * | 8/1984 | Van Sloun | F42B 12/62 102/505 |
| 4,604,939 | A | 8/1986 | Hoffmeister | |
| 6,799,517 | B1 * | 10/2004 | Cahill | F42C 13/00 102/401 |
| 8,893,604 | B1 * | 11/2014 | Gray | F41H 11/14 280/400 |
| 8,910,557 | B2 * | 12/2014 | Cox | F41A 23/24 89/1.51 |
| 2003/0051597 | A1 * | 3/2003 | O'Dwyer | F41A 19/65 89/1.11 |
| 2004/0244628 | A1 | 12/2004 | O'Dwyer | |
| 2005/0022657 | A1 | 2/2005 | O'Dwyer | |

* cited by examiner

*Primary Examiner* — J. Woodrow Eldred
(74) *Attorney, Agent, or Firm* — John P DiScala

(57) ABSTRACT

A scalable mine deployment system establishes a close range tactical anti-vehicle obstacle. The scalable mine deployment system includes a deployment pod, a munitions control unit and a remote control station. The deployment pod deploys anti-vehicle munitions in response to a control signal received at the remdte control station and relayed via the munitions control unit. The deployment pods are arranged according to desired field properties and are configured to deploy one or more munitions at a selectable density.

12 Claims, 8 Drawing Sheets

SCALABLE MINE DEPLOYMENT SYSTEM

CROSS-REFERENCE TO RELATED APPLICATIONS

This application claims the benefit under 35 USC § 119(e) of U.S. provisional patent application 62/481,341 filed on Apr. 4, 2017.

STATEMENT OF GOVERNMENT INTEREST

The inventions described herein may be manufactured, used and licensed by or for the United States Government.

BACKGROUND OF THE INVENTION

The invention relates in general to munitions and in particular to deployment systems for munitions.

Anti-vehicle minefields serve as an effective obstacle to military vehicles on a battlefield. These minefields are formed from munitions designed to be triggered by a vehicle and with sufficient effects to damage or disable the vehicle. Anti-vehicle minefields may serve many tactical purposes depending on the shape and density of the minefield. For example, the minefield may serve to fix, turn, block or delay.

International treaties and current landmine policies have restricted the use of munitions which have been employed in the past to create these anti-vehicle minefields. Accordingly, a need exists for a system which produces anti-vehicle minefields which are not persistent and therefore consistent with modern land mine policies and international treaties.

SUMMARY OF INVENTION

One aspect of the invention is a scalable mine deployment system for forming a non-persistent anti-vehicle minefield. The scalable mine deployment system comprises one or more hand emplaced deployment pods, one or more munitions control units and a remote control station.

The one or more hand emplaced deployment pods store one or more anti-vehicle munitions and deploy the one or more anti-vehicle munition to form a non-persistent minefield in response to a control signal. The one or more hand emplaced deployment pods are arranged according to a desired minefield area.

The remote control station receives a command from an operator and transmits a control signal corresponding to the command.

Each of the one or more munitions control units is in electric communication with one or more deployment pods. The munitions control units receive the control signal from the remote control station and transmit the control signal to the deployment pods.

A second aspect of the invention is a munition deployment pod for deploying one or more anti-vehicle munitions to form a non-persistent minefield at a desired density in response to a received remote control signal. The munition deployment pod further comprises a frame and one or more canisters removably attached to the frame. The frame houses electronic components. The one or more canisters are arranged symmetrically opposed to each other around the frame. The one or more canisters store and deploy the one or more anti-vehicle munitions.

A third aspect of the invention is a method for deploying a non-persistent anti-vehicle minefield scaled to a desired area. The method includes the steps of: arranging one or more deployment pods for storing and deploying one or more anti-vehicle munitions to form a non-persistent minefield in response to a control signal, the one or more hand emplaced deployment pods arranged according to a desired minefield area; receiving at a remote control station, a user input comprising a desired density for a portion of the non-persistent anti-vehicle minefield; transmitting a wireless control signal corresponding to the desired density to a munitions control unit; transmitting a control signal corresponding to the desired density to one or more deployment pods in the portion of the non-persistent anti-vehicle minefield; and adjusting an elevation angle of a canister according to the control signal.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

Figure 1:
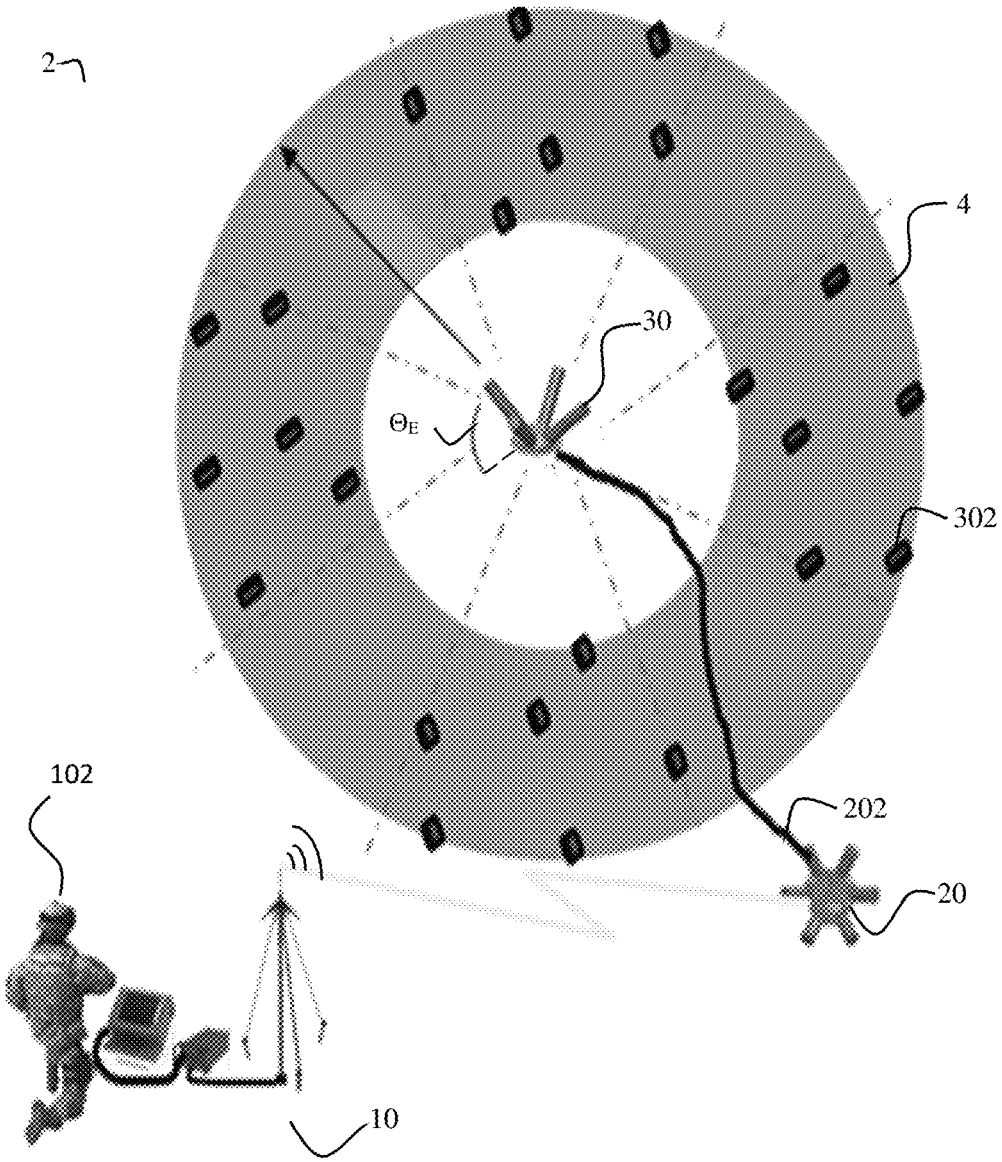
FIG. 1 is an illustration showing an operator employing a scalable mine deployment system to create a scalable minefield, in accordance with one illustrative embodiment.

A scalable mine deployment system allows the establishment of a close range tactical obstacle gap. The scalable mine deployment system provides a system which creates an anti-vehicle minefield. Importantly, the anti-vehicle minefield is not persistent and therefore consistent with current land mine policies and international treaties.

The scalable mine deployment system employs hand emplaced devices to create a block of area coverage. The scalable mine deployment system creates a versatile coverage area which may be used as a building block to form any size obstacle desired. This coverage area is created to contain the required mine density of an anti-vehicle minefield.

The system allows for the operator to emplace a variety of densities of a field with the same device and without having to change the position of the system components in the field. The operator can remotely deploy from a single emplaced component of the system a variety of densities which allows for the ability to deploy various purpose minefields, such as fix, turn, block or delay fields.

Further, the scalable mine system may deploy a protective anti-personnel minefield to protect the anti-vehicle minefield by making it difficult to breech. The scalable mine deployment system is interoperable with other anti-personnel munitions such as the M7 Spider Networked Munition. The Spider Networked Munition is a hand-emplaced remotely controlled man-in-the-loop antipersonnel munition system. Spider Networked Munitions may he deployed with the scalable mine deployment system for anti-personnel effects and centrally controlled.

The scalable mine deployment system is hand emplaced thereby negating reliance on aging vehicle based system. While the embodiment of the scalable mine deployment system described throughout the specification is hand emplaced, the scalable mine deployment system may he emplaced roboticalty or through other automated means.

Further, the scalable mine deployment system may be emplaced and left in emplace until deployment is required, unlike vehicle deployed systems. The operator can remotely control the minefield and can rapidly emplace ground based counter mobility and protection capability. Advantageously, an anti-vehicle minefield can be established in a "just in time" employment. The mines can be command deployed at any time.

If the mines are not deployed, the system is recoverable and reusable. Operators may preposition the system for a duration of time and only deploy if the need arises. If the system is not deployed, the operator remotely safes the system and retrieves the components for subsequent reuse.

The munition deployed in an embodiment of the invention is a mine and in particular an anti-vehicle mine, and throughout the specification, the terms mine and munition are used interchangeably. However, the munition deployed by the system is not limited to mines or anti-vehicle mines and may be any munition capable of being deployed by the system for establishing an anti-vehicle barrier.

Figure 2:
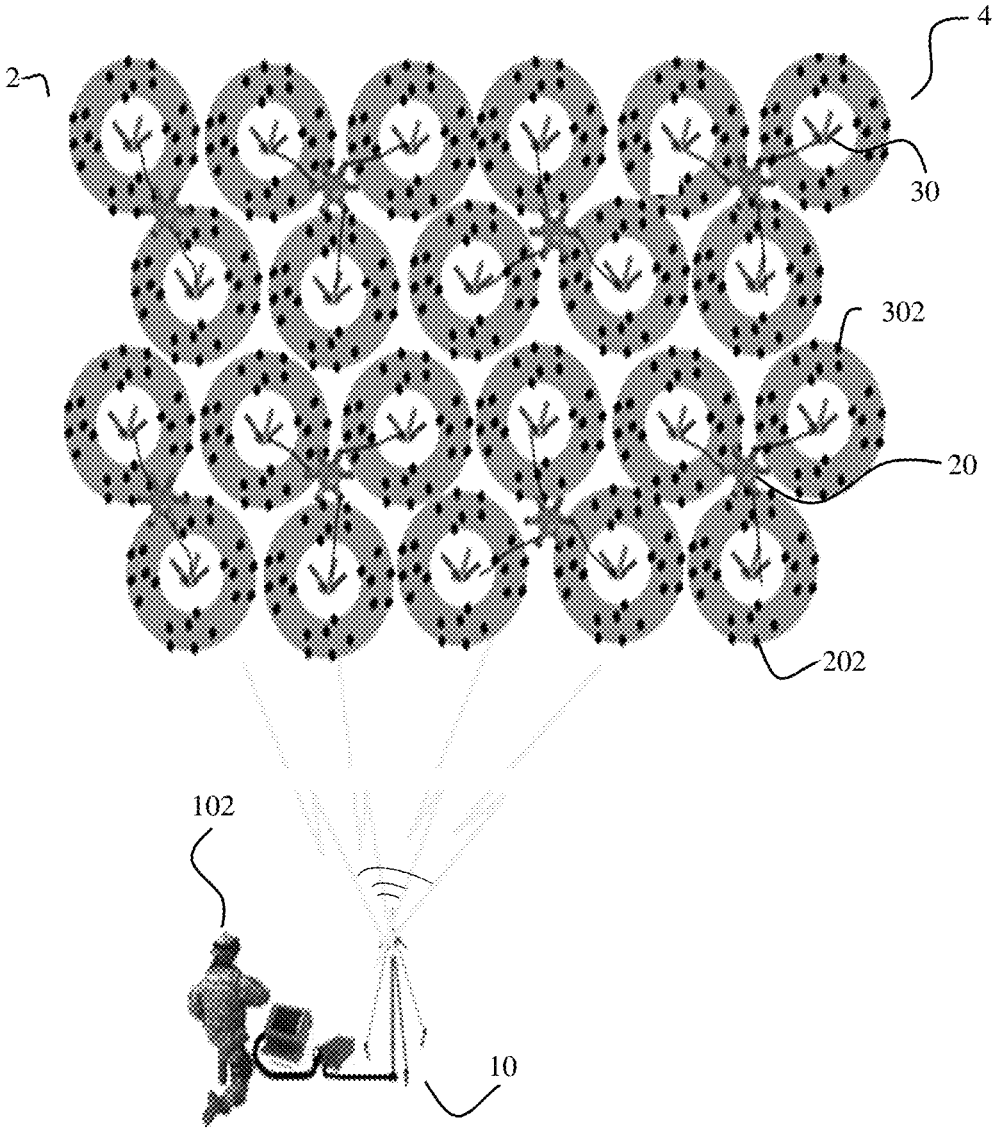
FIG. 2 is an illustration showing multiple scalable mine deployment systems creating a minefield, in accordance with one illustrative embodiment.

FIG. 1 is an illustration showing an operator employing a scalable mine deployment system to create a scalable minefield, in accordance with one illustrative embodiment. FIG. 2 is an illustration showing multiple scalable mine deployment systems creating a minefield, in accordance with one illustrative embodiment.

The scalable mine deployment system 2 comprises a remote control station 10, one or more munition control units 20 and one or more deployment pods 30 (also referred to as pods 30). Each deployment pod 30 stores anti-vehicle munitions (also referred to as mines 302) for future deployment to create a minefield 4. The one or more deployment pods 30 are pre-deployed throughout an area in a desired pattern for achieving the desired effect of the minefield 4. The pods 30 may be manually placed by an operator 102, placed via a ground vehicle or aircraft or remotely placed such as via a robot or drone, either as a separate component or integral to the pod 30. The desired pattern may be chosen based on terrain, area of coverage and purpose of minefield 4.

The munition control unit 20 is in communication with the one or more deployment pods 30. The remote control station 10 is in communication with the munition control units. In the embodiment shown, each munition control unit 20 is in electrical communication via a wired interface 202 with up to three pods 30. However, the munition control unit 20 is not limited to wired communication or three pods 30. Multiple munition control units 20 with associated pods 30 may be deployed in a desired scale to create a minefield 4 with desired coverage, as shown in FIG. 2.

An operator 102 enters a deploy command to the remote control station 10. The remote control station 10 transmits the deploy command to each of the munition control units 20. The munition control units 20 in turn transmit the command to each of their corresponding pods 30 to deploy the munitions 302 housed in their containers. In addition to a deploy command, an operator 102 may remotely set the elevation angle of the canisters (and thereby the minefield 4 density and area) via the remote control station 10 and munition control unit.

In one embodiment of the invention, the scalable mine deployment system 2 leverages the communication capabilities of the M7 Spider Networked Munition system and in certain applications may serve as an addition to the Spider Networked Munition. The Spider Networked Munition is a hand-emplaced, remotely controlled, Man-In-The-Loop antipersonnel munition system comprising a remote control station 10 in communication with munition control units 20 and various sensors. Spider provides equivalent munition field effectiveness when compared to capabilities provided by antipersonnel landmines, but does so without the residual life threatening risks after hostilities end or when warring factions depart.

Each munition is controlled by a remotely stationed soldier who monitors its sensors, allowing for more precise (non-lethal to lethal) responses—a significant advancement and advantage. The system's design allows for safe and rapid deployment, reinforcement, and recovery as well as safe passage of friendly forces. Spider eliminates the possibility of an unintended detonation through early warning and selective engagement of enemy forces. Spider is designed for storage, transport, rough handling, and use in worldwide military environments.

The scalable mine deployment system 2 leverages the communication capabilities of the Spider Networked Munition system to remotely deploy anti-vehicle minefields in addition to (or in replacement of) the anti-personnel minefields created with the Spider Networked Munition system. In these embodiments, the remote control station 10 and munition control units 20 are Spider Networked Munition remote control station and munition control units communicating via the same or similar protocols as those employed in the Spider Networked Munition. A wired interface added to the munition control unit 20 facilitates remote communication with the pods 30 and extends the communications capabilities of the Spider Networked Munition system to the anti-vehicle deployment pods 30.

Further, in embodiments, the mine deployment system may leverage components of the M87A1 Volcano Multiple Delivery Mine system. As will be described in further detail below, the pods 30 may employ canisters and munitions currently in use or similar to those currently in use in the Volcano Multiple Delivery Mine system. The Volcano Multiple Delivery Mine system is a mass scatterable mine delivery system that delivers mines by helicopter or ground vehicle. It enables tactical commanders to emplace anti-vehicle/antipersonnel or pure anti-vehicle minefields with a minimum of personnel. A Soldier-selectable, self-destruct mechanism destroys the mine 302 at the end of its active lifecycle 4 hours to 15 days—depending on the time selected.

The scalable mine deployment system 2 described herein, extends the canisters and munitions of the Volcano system to a hand-emplaced system. By providing a system for hand emplacing the munitions of the Volcano Multiple Delivery Mine system, operators 102 may create anti-vehicle minefields 4 without reliance on land or airborne vehicles.

Figure 3:
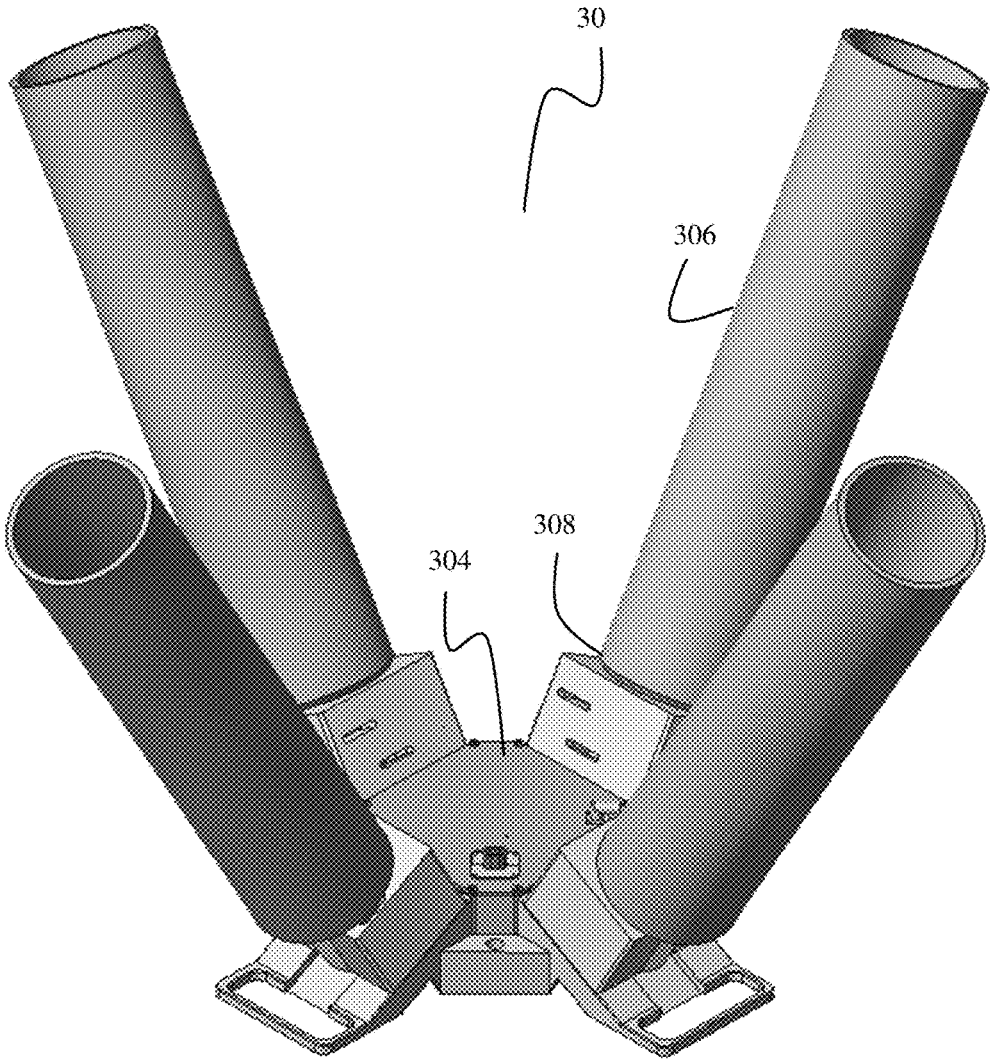
FIG. 3 is a top perspective view of a pod of the scalable mine deployment system with attached canisters, in accordance with one illustrative embodiment.

FIG. 3 is a top perspective view of a pod of the scalable mine deployment system with attached canisters, in accordance with one illustrative embodiment. Each pod 30 comprises a baseplate and a plurality of canisters. Each canister 306 houses one or more Volcano mines 302 for deployment. For example, in an embodiment, the canisters are the same or similar to those employed on the M87A1 Volcano Multiple Delivery Mine system, each capable of holding six Volcano mines 302. The canisters 306 are arranged symmetrically around the frame 310 such that the recoil forces generated when ejecting mines 302 is cancelled in the horizontal direction. By cancelling the horizontal component of recoil, the baseplate position is secure throughout deployment. Each pod 30 provides for 360 degrees of coverage.

The canisters are inserted into openings 308 defined by the baseplate 304. The canisters are secured to the baseplate 304 such that the proximate end to the baseplate 304 may rotate with respect to a horizontal axis of the baseplate 304 and thereby change their elevation angle ($\Theta_E$ in FIG. 1). By changing the elevation angle of the canister 306, the density and coverage of the minefield 4 may be adjusted to suit the particular needs of the application, The canisters may be rotated manually or mechanically such via a hinge or latch mechanism or they may be rotated remotely such as via a servo motor or actuator.

Figure 4:
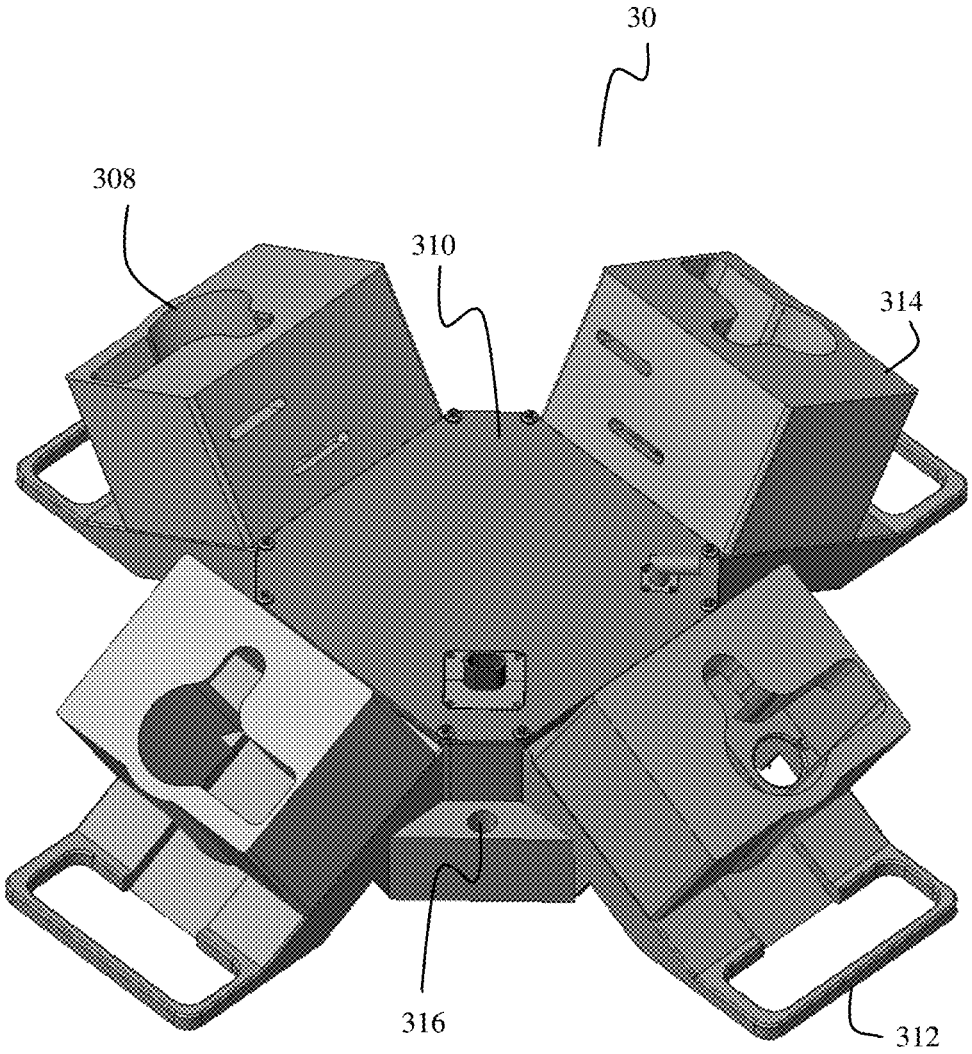
FIG. 4 is a top perspective view of a pod of the scalable mine deployment system, in accordance with one illustrative embodiment.

FIG. 4 is a top perspective view of a pod of the scalable mine deployment system, in accordance with one illustrative embodiment. The baseplate 304 comprises a frame 310, one or more handles 312 and one or more tube interfaces 314. The baseplate 304 is emplaced on the ground and secured by driving one or more stakes through corresponding holes 316 formed in the frame 310. Alternatively, spikes integral to the frame 310 may be either inserted into the ground or if conditions do not permit, laid horizontally to increase the area of the baseplate 304 and therefore the stability of the baseplate 314.

Figure 5:
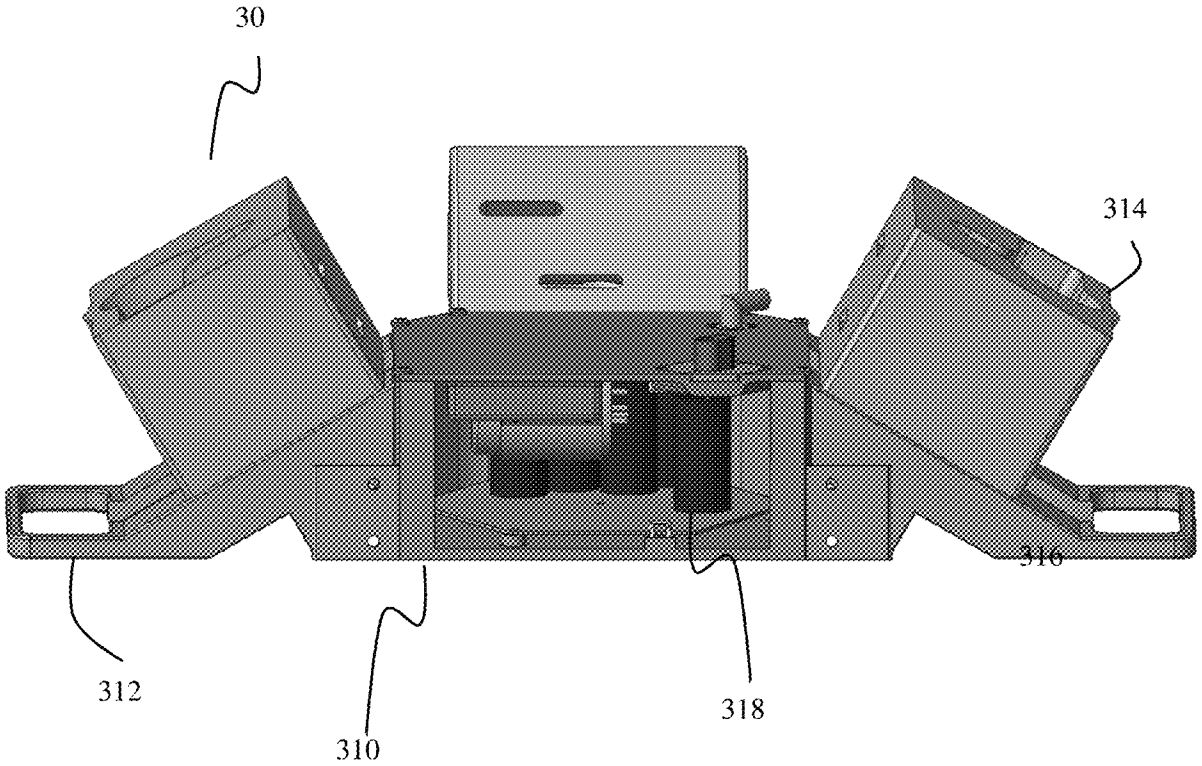
FIG. 5 is a front perspective view of a pod of the scalable mine deployment system with a cutout showing internal components of the pod, in accordance with one illustrative embodiment.

FIG. 5 is a front perspective view of a pod of the scalable mine deployment system with a cutout showing internal components of the pod 30, in accordance with one illustrative embodiment. The frame 310 serves as a central housing providing support and protection for electronic components 318 housed within. The electronic components 318 may comprise a power source such as a battery, communication interfaces, firing electronics, mine SD set circuitry and motor controls for the canisters. The frame 310 may be made of plastic material, metal material or any other material suitable for the purposes described above.

One or more handles 312 are attached to and extend from the sides of the frame 310 to provide a surface for carrying, as well as to increase the stability of the baseplate 304 when it is in a deployed state. Further, each of the handles 312 may provide a mounting surface for the tube interface modules 314. The tube interface modules 314 secure each of the one or more canisters 306 to the frame 310. A canister 306 is inserted into a corresponding opening 308 defined by a face of the tube interface module 314. The canister 306 is then rotated to engage a locking mechanism and secure the canister 306 within the tube interface module 314. In an embodiment of the invention, the canister 306 rotates within the tube interface module 314. In another embodiment, the canister 306 and tube interface module 314 rotate together with respect to the baseplate 304.

Figure 6:
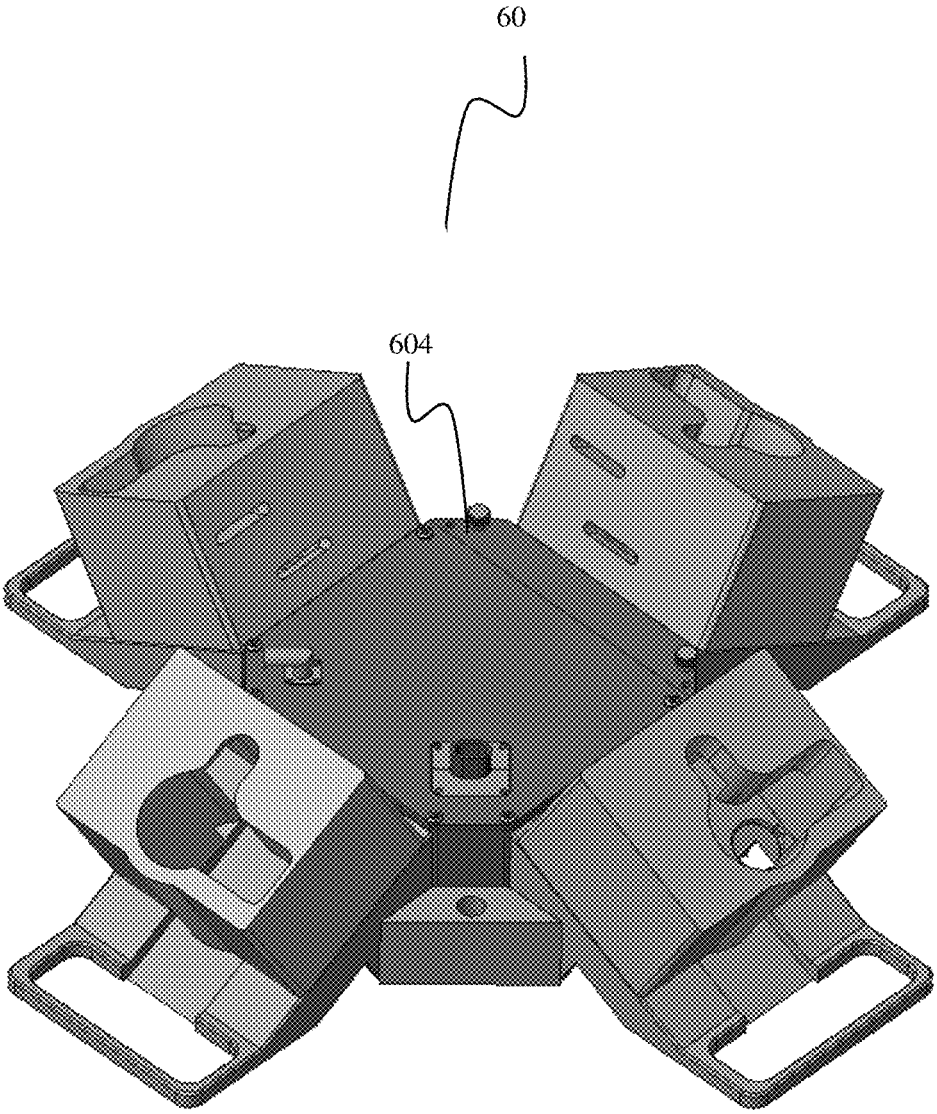
FIG. 6 is a top perspective view of a trainer pod of the scalable mine deployment system, in accordance with one illustrative embodiment.
Figure 7:
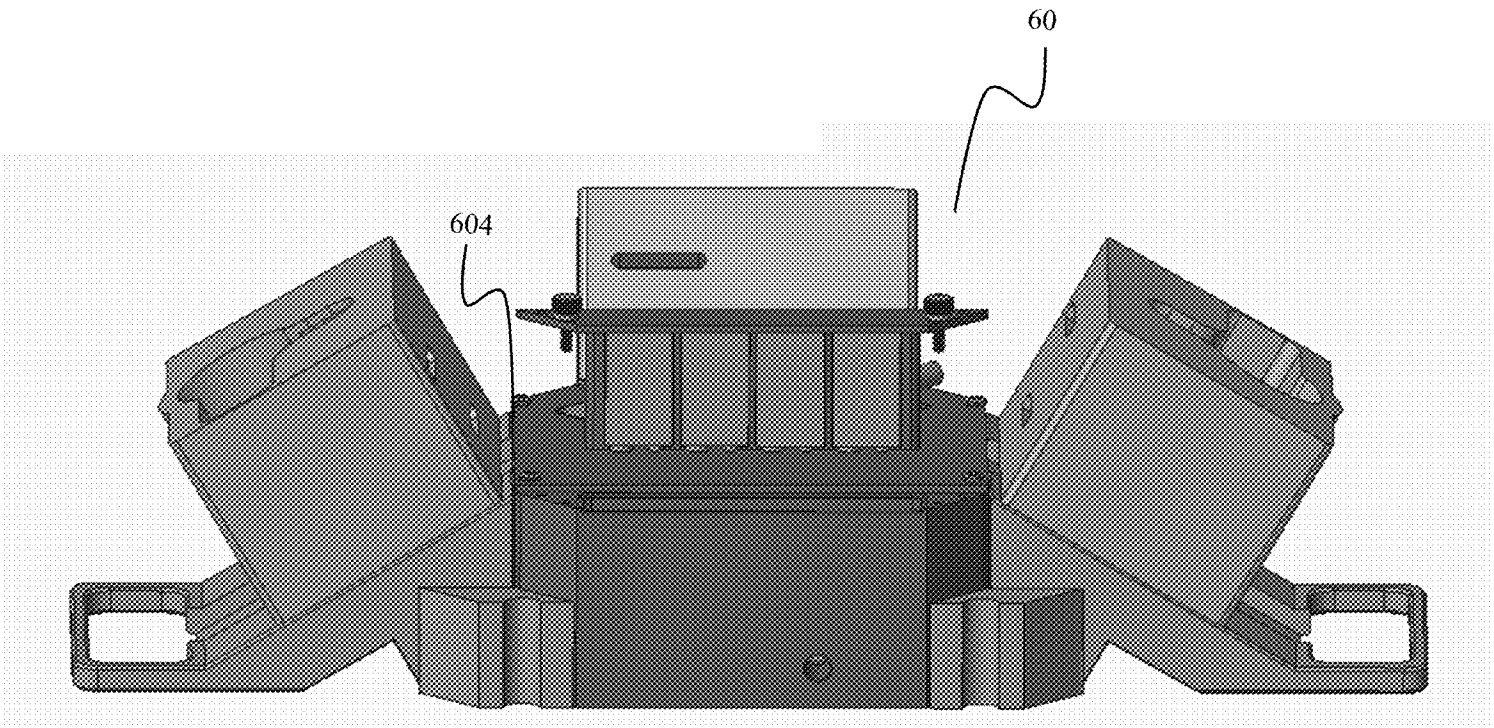
FIG. 7 is a front perspective view of a trainer pod of the scalable mine deployment system with a cutout showing internal components of the pod, in accordance with one illustrative embodiment.

FIG. 6 is a top perspective view of a trainer pod of the scalable mine deployment system, in accordance with one illustrative embodiment. FIG. 7 is a front perspective view of a trainer pod of the scalable mine deployment system 2 with a cutout showing internal components of the pod, in accordance with one illustrative embodiment. Training pods 60 may be employed for training operators 102 in the storage, transport, setup and deployment of the scalable mine deployment system 2. The training pods 60 are non-functional but are similar in size and shape to the tactical deployment pod 30 described above.

Each training pod 60 comprises a baseplate 604 and a plurality of training canisters. Each training canister is non-functional but similar in size and shape to the tactical canisters 306 describe above. The training canisters 306 are arranged symmetrically around a training frame 610.

The training canisters are inserted into openings 608 defined by the training baseplate 304. The training canisters are secured to the training baseplate 304 such that a proximate end to the training baseplate 604 may rotate with respect to a horizontal axis of the training baseplate 604 and thereby change their elevation angle. The training canisters may be rotated manually or mechanically such via a hinge or latch mechanism or they may he rotated remotely such as via a servo motor or actuator.

The training baseplate 604 comprises a frame 610, one or more handles 612 and one or more tube interfaces 614. The frame 610 comprises holes 616 for receiving one or more emplacement stakes. The frame 610 may be made of plastic material, metal material or any other material suitable for the purposes described above. One or more handles 612 are attached to and extend from the sides of the frame 610 to provide a surface for carrying, as well as to increase the stability of the baseplate when it is in a deployed state. Further, each of the handles 612 may provide a mounting surface for the tube interface modules 614. The tube interface modules 614 secure each of the one or more canisters to the baseplate.

Figure 8:
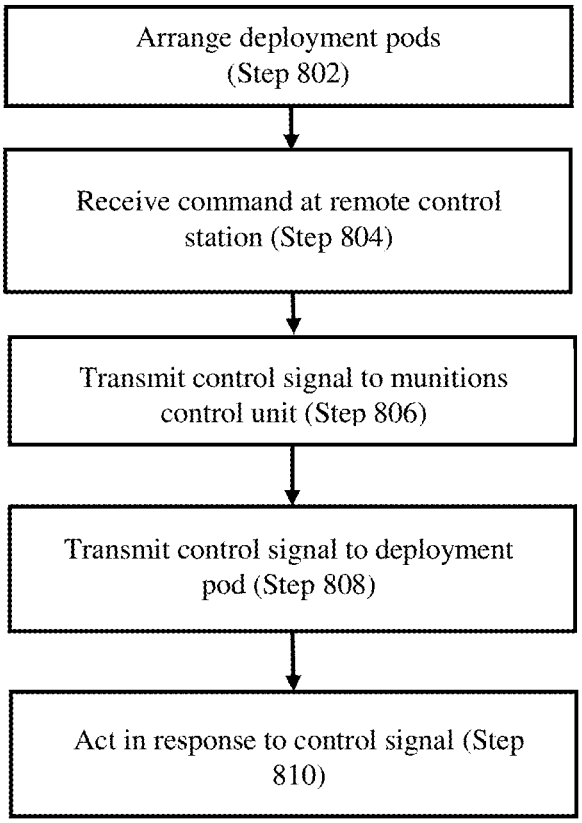
FIG. 8 is a schematic flowchart illustrating a method for deploying a deploying a non-persistent anti-vehicle minefield scaled to a desired area, in accordance with one illustrative embodiment.

FIG. 8 is a schematic flowchart illustrating a method for deploying a non-persistent anti-vehicle minefield 4 scaled to a desired area, in accordance with one illustrative embodiment. The method 800 for deploying a non-persistent anti-vehicle minefield 4 scaled to a desired area comprises the steps of: arranging one or more deployment pods 30 for storing and deploying one or more anti-vehicle munitions 302 according to a desired minefield area 802; receiving at a remote control station 10, a user input 804; transmitting a wireless control signal corresponding to the user input to a munitions control unit 806; transmitting a control signal corresponding to the user input to one or more deployment pods in the portion of the non-persistent anti-vehicle minefield 808; and the deployment pod 30 acting according to the control signal 810.

At step 802, one or more deployment pods 30 are arranged according to a desired minefield 4. The desired minefield area and density determines the number of deployment pods 30 required. The deployment pods 30 may be arranged by hand by an operator 102 or may be deployed by autonomous vehicles such as robots or unmanned aerial vehicles.

At step 804, a user input is received at the remote control station 10. The user may input the command via a user interface such as a graphical user interface or textual user interface or may input the command via a separate device configured to communicate with the remote control station 10.

A user may input a density command thereby inputting the desired density of the minefield 4. The user may input variable densities for different portions of the minefield 4. Accordingly, the minefield 4 may have variable density with portions of the minefield 4 having a greater density of mines 302 and portions of the minefield 4 having a lower density.

A user may input an arm command to arm the munitions 302 in the deployment pod 30. The munitions 302 in the deployment pods may be armed for a set period of time. A user may input a deploy command to dispense the munitions 302 from the deployment pods 30. Finally, should armed munitions 302 not be deployed, a user may input a safe command to safe the previously armed munitions 302 for safety purposes and to preserve the munitions 302 for later use.

At step 806, the remote control station 10 transmits a wireless control signal corresponding to the user input to a munitions 302 control unit 804. Depending on the intended recipient, the remote control station 10 may broadcast the wireless control signal to all munition control units 20 or may address the control signal to a subset of munition control units 20.

At step 808, the munition control unit 20 transmits a control signal corresponding to the user input to one or more deployment pods 30.

At step 810, the deployment pod 30 acts according to the control signal. For a control signal corresponding to a density input, the deployment pod 30 adjusts the angle of elevation of the canisters 306. In an embodiment of the invention, the angle of elevation may be adjusted by a servo motor according to the control signal. For a control signal corresponding to an arm command, the munitions 302 are armed within the canisters 306. For a control signal corresponding to a deploy input, the canister 306 deploys the munitions 302 from the canister 306 to the surrounding area. In situations in which the munitions 302 are armed but not deployed, for a control signal corresponding a safe input, the canister 306 safes the munitions 302 for safety and later retrieval for reuse.

While the invention has been described with reference to certain embodiments, numerous changes, alterations and modifications to the described embodiments are possible without departing from the spirit and scope of the invention as defined in the appended claims, and. equivalents thereof.

What is claimed is:

1. A scalable mine deployment system comprising:

one or more free-standing ground emplaced deployment pods for storing and deploying one or more anti-vehicle munitions to form a non-persistent minefield in response to a control signal, the one or more free-standing ground emplaced deployment pods arranged according to a desired minefield area and each further comprising a frame, a plurality of canisters, for storing the one or more anti-vehichle munitions, the caniters arranged radially outward from and uniformly around a central longitudinal axis in 360 degrees and symmetrically opposed to each other such that recoil forces generated on the deployment pod when ejecting the one or more anti-vehicle, mines from the plurality canisters are cancelled in a horizontal direction and wherein for each of the plurality of canisters, a proximate end of the canister is rotatably attached to the frame and configured to be rotated with respect to a horizontal axis according to the desired density and in response to a control signal, and one or more handles extending outward in a horizontal direction from the frame in the same radial direction as the one or more canisters and in alignment with a bottom surface of the frame;

a remote control station for receiving a command from an operator and transmits a control signal corresponding to the command; and one or more munitions control units, each of the one or more munitions control units in electric communication with one or more deployment pods for receiving the control signal from the remote control station and transmitting the control signal to the deployment pods and wherein each of the one or more munitions control units is further configured for storing and deploying anti-personnel munitions in response to a control signal.

2. The scalable mine deployment system of claim 1 wherein the remote control station transmits the control signal wirelessly.

3. The scalable mine deployment system of claim 1 wherein each of the one or more munition control units transmits the control signal via a wired communication interface.

4. The scalable mine deployment system of claim 1 wherein each of the one or more pods is configured for arming one or more anti-vehicle munitions in response to a control signal.

5. The scalable mine deployment system of claim 4 wherein each of the one more anti-vehicle munitions self-destruct according to a predefined period of time.

6. A munition deployment pod for deploying one or more anti-vehicle munitions to form a non-persistent minefield at a desired density in response to a received remote control signal, the munition deployment pod being free-standing and ground emplaced and further comprising:

a frame for housing electronic components; and a plurality of canisters removably attached to the frame and for storing the one or more anti-vehicle munitions, the canisters arranged radially outward from and uniformly around a central longitudinal axis in 360 degrees and symmetrically opposed to each other such that recoil forces generated on the deployment pod when ejecting the one or more anti-vehicle mines from the plurality of canisters are cancelled in a horizontal direction and wherein for each of the plurality of canister, a proximate end of the canister is rotatably attached to the frame and configured to be rotated with respect to a horizontal axis according to the desired density and in response to a control signal, and one or more handles extending outward in a horizontal direction from the frame in the same radial direction as the one or more canisters and in alignment with a bottom surface of the frame.

7. The munition deployment pod of claim 6 further comprising tube interface modules attached to the frame for receiving the one or more canisters.

8. The munition deployment pod of claim 6 wherein the munition deployment pod is emplaced by a robotic vehicle.

9. A method for deploying a non-persistent anti-vehicle minefield scaled to a desired area, the method comprising:

arranging one or more free-standing ground emplaced deployment pods for storing and deploying one or more anti-vehicle munitions to form a non-persistent minefield in response to a control signal, the one or more free-standing ground emplaced deployment pods arranged according to a desired minefield area and each further comprising a frame, a plurality of canisters for storing the one or more anti-vehichle munitions, the canisters arranged radially outward from and uniformly around a central longitudinal axis in 360 degrees and symmetrically opposed to each other such that recoil forces generated on the deployment pod when ejecting the one or more anti-vehicle mines from the plurality of canisters are cancelled in a horizontal direction and wherein for each of the plurality of canisters, a proximate end of the canister is rotatably attached to the frame and confrigured to be rotated with respect to a horizontal axis according to the desired density and in response to a control signal, and one or more handles extending outward in a horizontal direction from the frame in the same radial direction as the one or more canisters and in alignment with a bottom surface of the frame;

receiving at a remote control station, a user input comprising a desired density for a portion of the non-persistent anti-vehicle minefield;

transmitting a wireless control signal corresponding to the desired density to a munitions control unit;

transmitting a control signal corresponding to the desired density to one or more deployment pods in the portion of the non-persistent anti-vehicle minefield; and adjusting an elevation angle of the plurality of canisters according to the control signal.

10. The method of claim 9 further comprising the steps of:

receiving at a remote control station, a user input comprising an arm command;

transmitting a wireless control signal corresponding to the arm command to a munitions control unit;

transmitting a control signal corresponding to the arm command to one or more deployment pods; and arming one of more anti-vehicle munitions according to the control signal.

11. The method of claim 10 further comprising the steps of:

receiving at a remote control station, a user input comprising a deployment command;

transmitting a wireless control signal corresponding to the deployment command to a munitions control unit;

transmitting a control signal corresponding to the deployment command to one or more deployment pods; and deploying one or more anti-vehicle munitions from the one or more deployment pods according to the control signal.

12. The method of claim 10 further comprising the steps of:

receiving at a remote control station, a user input comprising a safe command;

transmitting a wireless control signal corresponding to the safe command to a munitions control unit;

transmitting a control signal corresponding to the safe command to one or more deployment pods; and safeing one or more anti-vehicle munitions according to the control signal; and retrieving the one or more deployment pods.

* * * * *